United States Patent [19]

Vasilantone

[11] 4,209,294

[45] Jun. 24, 1980

[54] INFRARED DRYER

[76] Inventor: Michael Vasilantone, 34 Columbia Rd., Somerville, N.J.

[21] Appl. No.: 951,222

[22] Filed: Oct. 13, 1978

[51] Int. Cl.[2] ..... F27D 1/12

[52] U.S. Cl. ..... 432/233; 432/175; 432/238

[58] Field of Search ..... 34/4, 39, 41; 432/175, 432/233, 238, 219

[56] References Cited

U.S. PATENT DOCUMENTS

| | | | |
|---|---|---|---|
| 2,186,032 | 1/1940 | Mann | 34/41 |
| 2,248,526 | 7/1941 | Francois | 34/4 |
| 2,347,407 | 4/1944 | Goodwin et al. | 34/4 |
| 2,355,671 | 8/1944 | Naeher et al. | 34/233 |
| 3,151,950 | 10/1964 | Newman et al. | 34/4 |
| 3,849,063 | 11/1974 | Eichenlaub | 34/4 X |

*Primary Examiner*—John J. Camby

*Attorney, Agent, or Firm*—Edward E. Dysun; John J. Byrne

[57] ABSTRACT

Disclosed is an infrared dryer which comprises at least one infrared heater and a pair of mutually parallel air troughs which guide ambient air from an intake end of the dryer, along the top of the dryer, and empty air into a collector box of the air plenum at the downstream end of the dryer. One of the air troughs runs along the top of the infrared heater and is ported to accept effluent air from the heating chamber, and the other of the air troughs extends along the upper surface of the dryer and serves to continually cool the upper surface or cover of the dryer.

16 Claims, 4 Drawing Figures

INFRARED DRYER

TECHNICAL FIELD

This invention relates to infrared dryers such as are used to dry freshly painted objects.

BACKGROUND OF PRIOR ART

Devices of this general type typically employ one or more blowers which draw in ambient air for use both in drying the object to be dried and in cooling selected portions of the apparatus. For instance in U.S. Pat. No. 3,151,950 to Newman, a plurality of transversely oriented air handling units draw air across the top of the dryer and then over a sheet to be dried. U.S. Pat. No. 2,355,671 to Naeher contains a generally similar disclosure. Dual longitudinal air paths are also known from, for instance, U.S. Pat. No. 3,849,063 to Eichenlaub

BRIEF SUMMARY OF INVENTION

The subject invention is an infrared dryer which comprises at least one infrared heater and a pair of air troughs, one upper and one lower, which guide ambient air from an intake end of the dryer, along the top of the dryer, and empty air into a collector box situated in an air plenum at the downstream end of the dryer. The lower air trough runs along the top of the infrared heater and is ported to accept effluent air from the heater chamber, and the upper air trough extends along the upper surface of the dryer adjacent to the cover and serves to continually cool the upper surface or cover of the dryer.

DETAILED DESCRIPTION OF THE PRESENTLY PREFERRED EMBODIMENT

Figure 1:
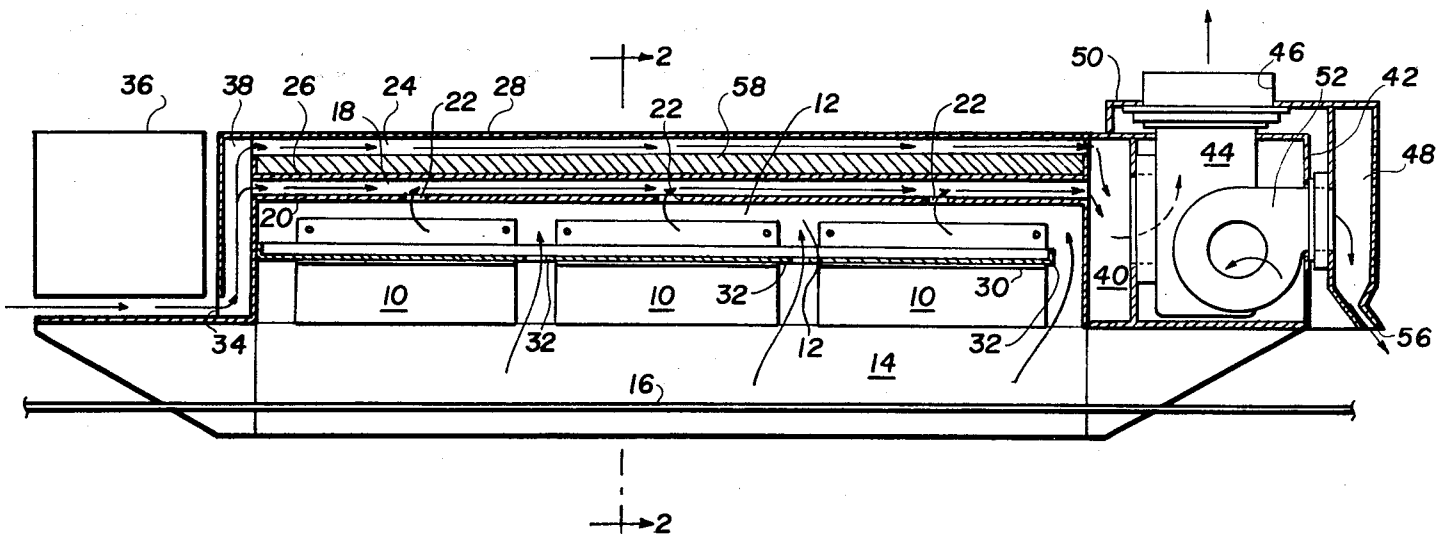
FIG. 1 is a longitudinal sectional view of the presently preferred embodiment, taken along the line 1—1 in FIG. 2.
Figure 2:
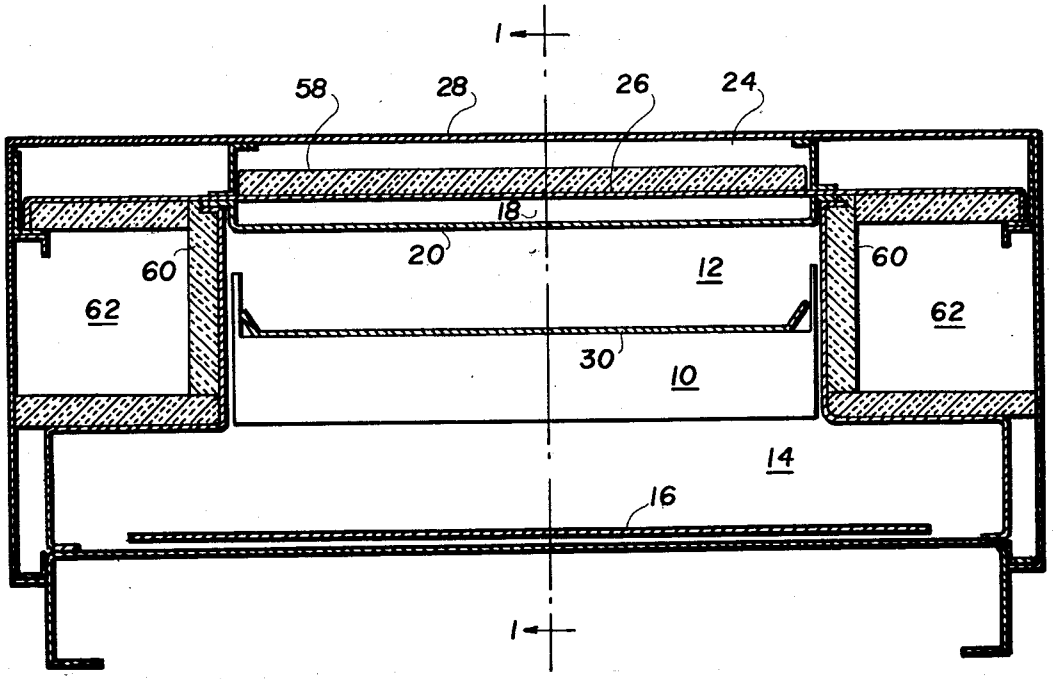
FIG. 2 is a transverse sectional view of the presently preferred embodiment, taken along the line 2—2 in FIG. 1.

The infrared dryer shown in the drawings comprises a plurality of infrared heaters 10 mounted in a secondary heat chamber 12 adjacent to a primary heat chamber 14 in which objects (not shown) carried on an endless conveyor 16 are to be dried. A first air trough 18 defined by a first air trough plate 20 disposed above the secondary heat chamber 12 is ported at 22 to accept effluent air from the secondary heat chamber 12. A second air trough 24 defined by a second air trough plate 26 is disposed above the first air trough 18, extends along the upper surface or cover 28 of the dryer, and serves to continually cool the upper surface or cover 28. A baffle 30 defines the boundary between the primary heat chamber 14 and the secondary heat chamber 12. The baffle 30 has appertures 32 for the passage of effluent air from the former to the latter.

Figure 4:
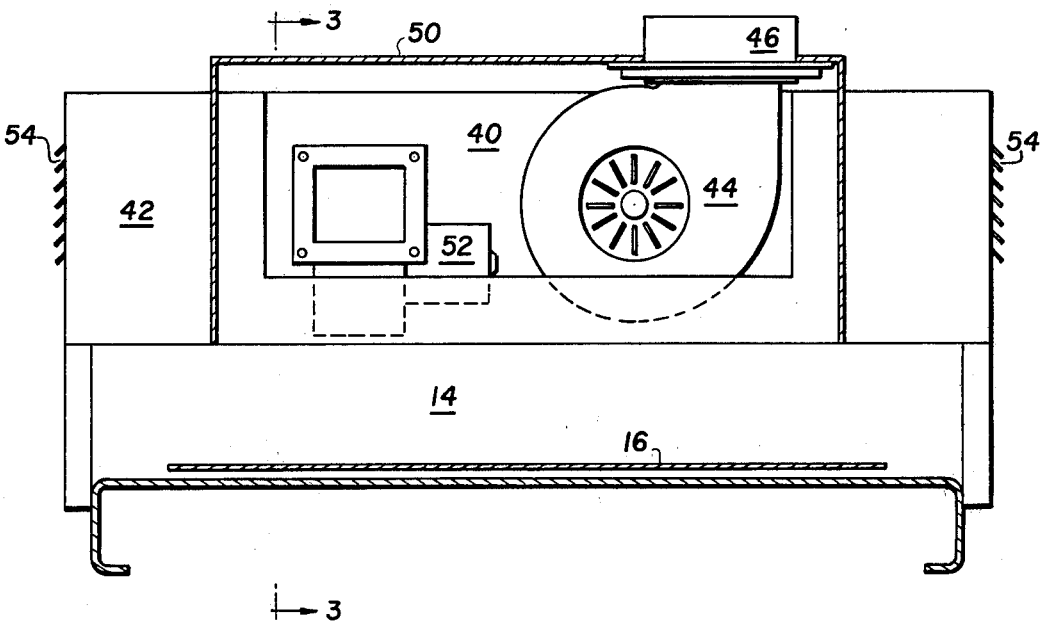
FIG. 4 is a view along the line 4—4 in FIG. 3.

Ambient air enters the dryer through an inlet 34 (shown adjacent to the control box 36) which leads to a secondary, or metering, air box 38. From the secondary air box 38, the air splits. The greater part goes into the first air trough 18, where it mixes with effluent air from the primary heating chamber 14 which has passed through the apertures 32 in the baffle 30 or around the edges of the baffle 30 into the secondary heating chamber 12, and from there through the ports 22 into the first air trough 18. The lesser part goes into the second air trough 24, where it cools the upper surface or cover 28 of the dryer. At the downstream ends of the first and second air troughs 18 and 24, the air is reunited in a primary, or collector, air box 40 located in an air plenum 42. From the primary air box 40, all of the air is drawn through an exhaust blower 44 (best seen in FIG. 4) and exits the dryer via a stack 46.

Figure 3:
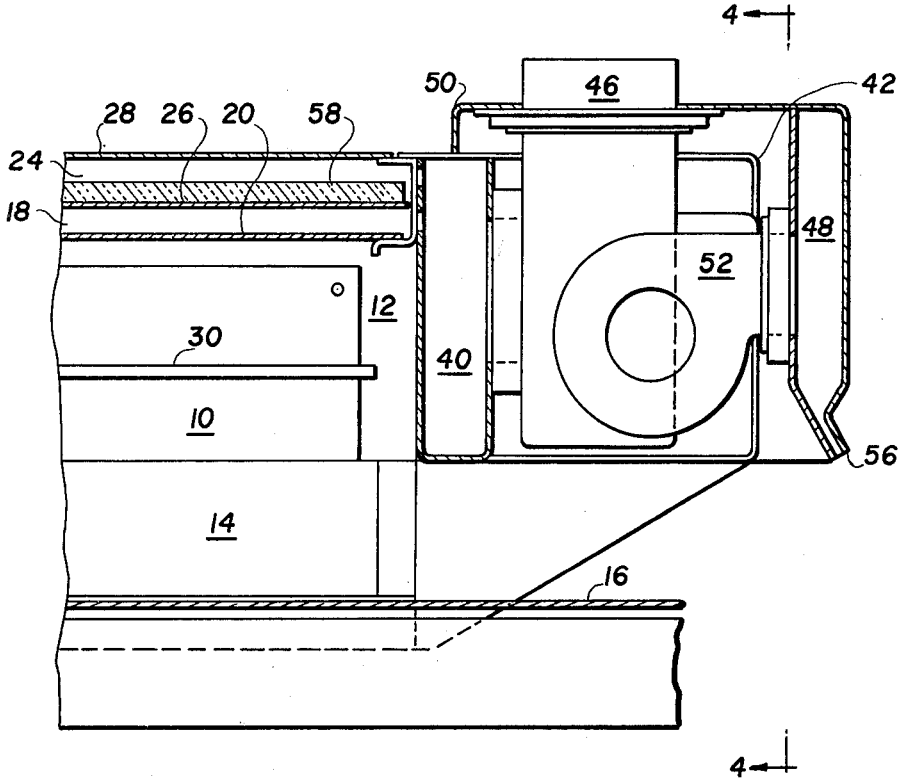
FIG. 3 is an enlarged view of the right-hand portion of FIG. 1 taken along the line 3—3 in FIG. 4.

A separate cool cabinet 48 is provided attached to the rear of the air plenum 42. The cooler cabinet 48 is provided with an extended canopy 50 for mounting the exhaust blower 44 and the stack 46. The cooler cabinet 48 and a second blower 52 (shown in FIGS. 1 and 3) draw air via intake slots 54 shown in FIG. 4) on the side walls of the air plenum 42. A thin wall of cooling air is discharged from the cooler cabinet 48 through a linear aperture 56 across the width of the entire exiting conveyor 16.

A layer of insulation 58 is disposed between the first and second air troughs 18 and 24 to shield the flow of cooler ambient air passing through the second air trough 24 from the relatively hot mixed air passing through the first air trough 18. Similarly, layers of insulation 60 are provided between the heat chambers 14 and 12 and troughs 62, at least one of which serves as a wireway, in the sides of the dryer.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A heating device comprising:
   (a) at least one heater mounted in a secondary heat chamber and exending into a primary heat chamber in which objects are to be exposed to heat;
   (b) a first air trough defined by a first air trough plate disposed above said secondary heat chamber, said first air trough plate being ported to accept effluent air from said secondary heating chamber; and
   (c) a second air trough defined by a second air trough plate disposed above said first air trough, extending along the upper surface or cover of the dryer, and serving to continually cool the upper surface of the dryer.

2. A heating device as recited in claim 1 and further comprising a blower in fluid communication with said first and second air troughs for moving air therethrough.

3. A heating device as recited in claim 1 and further comprising means for moving ambient air through said second air trough.

4. A heating device as recited in claims 1 or 3 and further comprising means for moving ambient air through said first air trough.

5. A heating device as recited in claim 1 wherein said first and second air troughs are mutually parallel.

6. A heating device as recited in claims 1 or 5 and further comprising a layer of insulation disposed between said first and second air troughs.

7. A heating device as recited in claim 1 and further comprising a secondary air box disposed upstream of and in fluid communication with both said first and second air troughs.

8. A heating device as recited in claim 1 comprising a plurality of heaters disposed in said secondary heat chamber.

9. A heat device as recited in claim 1 and further comprising a baffle defining the boundary between said primary and secondary heat chambers, said baffle having appertures therein for the passage of effluent air from said primary heat chamber into said secondary heat chamber.

10. An infrared dryer comprising a heating chamber containing at least one infrared heater and a pair of air troughs which guide ambient air from an intake end of the dryer, along the top of the dryer, and empty air into a collector air box located in an exhaust plenum at the downstream end of the dryer, one of said air troughs running along the top of the infrared heater and being ported to accept effluent air from the heating chamber and the other of said air troughs extending along the upper surface of the dryer and serving to continually cool the top of the dryer.

11. A heating device as recited in claim 1 wherein said heater is an infrared heater.

12. A heating device as recited in claim 1 wherein said device is a dryer and objects are dried in said primary heat chamber.

13. A heating device as recited in claim 1 and further comprising a primary air box disposed downstream of and in fluid communication with both said first and second air troughs.

14. A heating device as recited in claim 1 and further comprising means for moving ambient air against said objects as they exit from said primary heat chamber.

15. A heating device as recited in claim 1 and further comprising means for moving said objects through said primary heat chamber.

16. A heating device comprising:

(a) at least one heater mounted in a secondary heat chamber and extending into a primary heat chamber in which objects are to be exposed to heat;

(b) a baffle defining the boundary between said primary and secondary heat chambers, said baffle having apertures therein for the passage of effluent air from said primary heat chamber into said secondary heat chamber;

(c) a first air trough defined by a first air trough plate disposed above said secondary heat chamber, said first air trough plate being ported to accept effluent air from said secondary heat chamber;

(d) a second air trough defined by a second air trough plate disposed above said first air trough, extending along the upper surface or cover of the dryer, and serving to continually cool the upper surface of the dryer; and (e) means for moving ambient air through said first and second air trough.

* * * * *